US005176603A

United States Patent [19]

Hundley et al.

[11] Patent Number: 5,176,603

[45] Date of Patent: Jan. 5, 1993

[54] EXERCISE BOARD

[75] Inventors: Kenneth W. Hundley, Sun Valley; Patricia Carney, Santa Cruz; Robert Grant, San Francisco, all of Calif.

[73] Assignee: Emilie Conrad-Da'oud, Inc., Woodland Hills, Calif.

[21] Appl. No.: 621,470

[22] Filed: Nov. 30, 1990

[51] Int. Cl.[5] ..... A63B 26/00

[52] U.S. Cl. ..... 482/140; 482/145

[58] Field of Search ..... 272/109, 125, 134, 138, 272/145, 116, 117, 118; 128/25 R; 482/104, 106, 140, 142, 143, 144, 145

[56] References Cited

U.S. PATENT DOCUMENTS

| | | | |
|---|---|---|---|
| 2,240,228 | 4/1941 | Schall | 482/104 |
| 4,098,502 | 7/1978 | Faust | 482/104 |
| 4,423,865 | 1/1984 | Mahnke | 48/104 |
| 4,583,731 | 4/1986 | Crivello | 272/136 |
| 4,634,119 | 1/1987 | Pesthy | 272/136 |
| 4,641,837 | 2/1987 | Ruth | 482/104 |
| 4,749,190 | 6/1988 | Jennings | 482/106 |
| 4,765,615 | 8/1988 | Wolff | 272/144 |
| 4,765,616 | 8/1988 | Wolff | 272/123 |
| 4,826,157 | 5/1989 | Fitzpatrick | 272/118 |
| 4,923,195 | 5/1990 | Calderowe | 272/134 |

FOREIGN PATENT DOCUMENTS

| | | | |
|---|---|---|---|
| 8803825 | 6/1988 | Australia | 272/145 |
| 3417719 | 11/1985 | Fed. Rep. of Germany | 272/144 |

OTHER PUBLICATIONS

Coach & Athlete Incline bench 199, Scouting, Aug.-/Sep. 1981.

Athletic Journal—Crunch bench, p. 33, Just ask Universal, Mar. 1982.

*Primary Examiner*—Richard J. Apley

*Assistant Examiner*—Jerome Donnelly

*Attorney, Agent, or Firm*—Spensley Horn Jubas & Lubitz

[57] ABSTRACT

Disclosed herein is an exercise device. It includes an I shaped base; a seat of a first length; a pad of a second length, the pad being at least 1/5 the length of the seat. The pad is adjustably located with respect to the seat. Further there are adjustable support means attached between said seat and said base. With this construction, the seat may be angularly adjusted with respect to the base and the pad may be adjusted along various planes with respect to the seat.

20 Claims, 4 Drawing Sheets

EXERCISE BOARD

RELATED APPLICATION

This is a continuation in part of the design application filed on Nov. 28, 1990 by present inventors for the present exercise board. That application is incorporated herein by reference.

TECHNICAL FIELD OF THE INVENTION

The present invention relates to an exercise device which is mobile, light and which may be adjusted into a plurality of positions.

IN THE DRAWINGS

The present invention will be better appreciated from the enclosed drawings.

DESCRIPTION OF THE INVENTION

Figure 1:
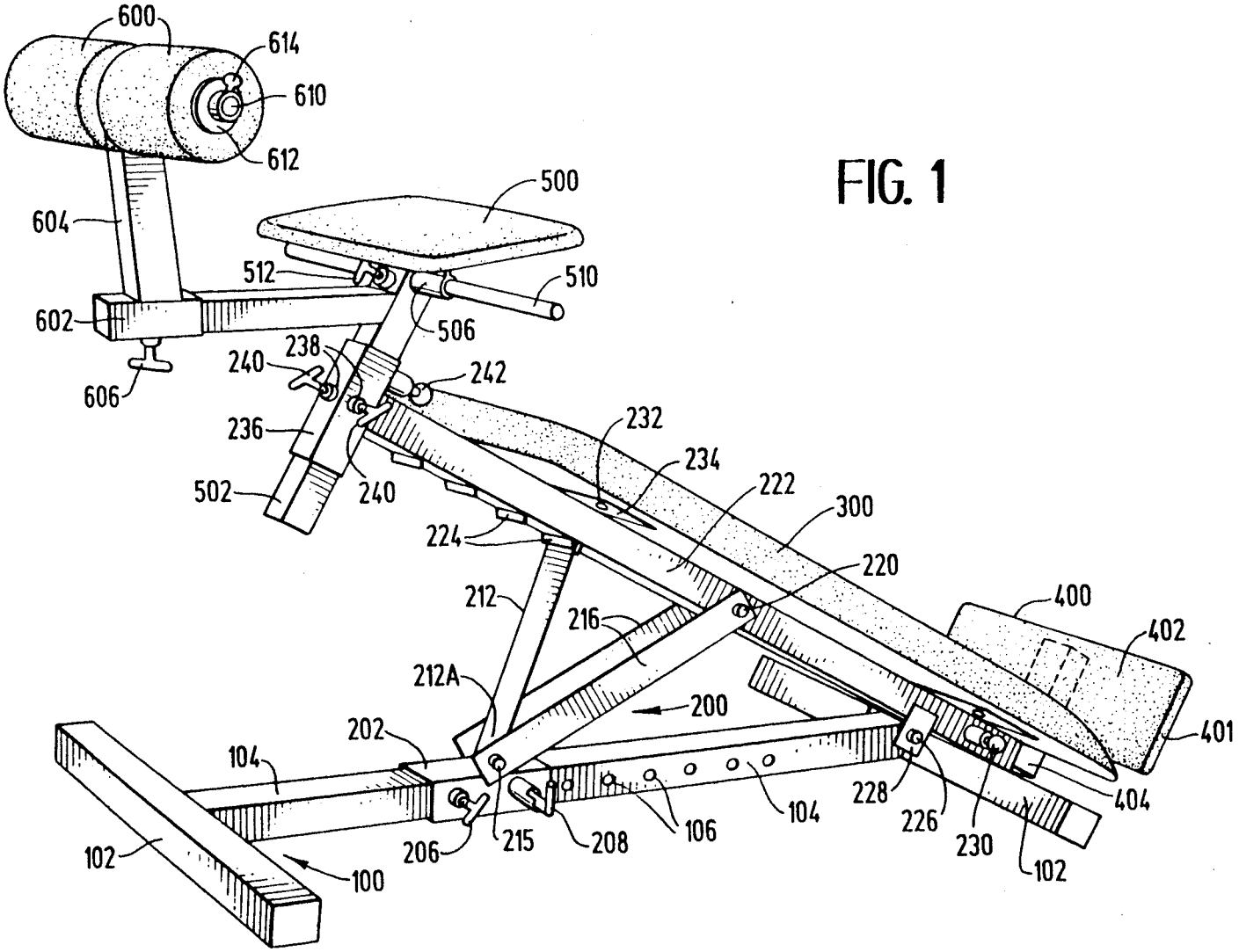
FIG. 1 is a perspective view of the device with all accessories shown thereon.
Figure 2:
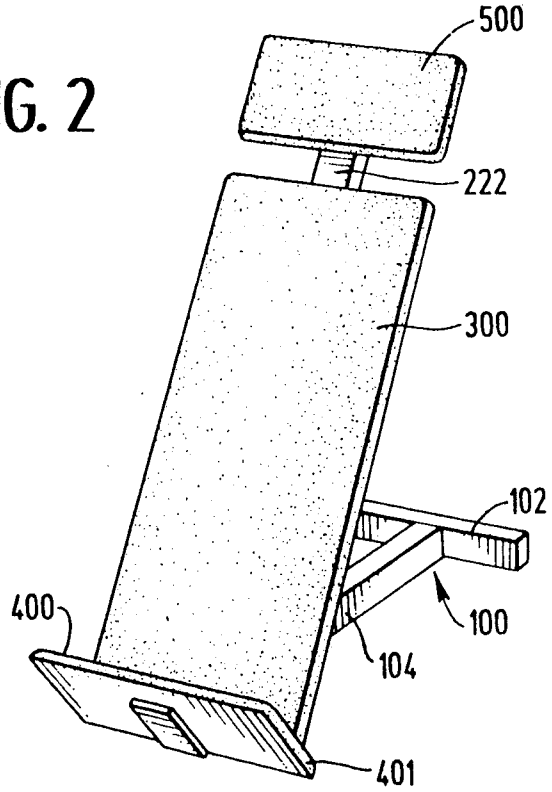
FIG. 2 is a second perspective and diagrammatic view of the device with the rollers missing.

Turning now to FIGS. 1 and 2, a broad overview of the invention can be seen. Forming the base of the invention is an I-shaped base rail 100 which is placed on the ground. Adjustably attached to this base rail 100 by means of adjustment means 200 is a generally flat padded and elongated seat 300. Seat 300 is detachably connected at one end to foot plate 400, and through connection means 200 detachably connected at its opposite end to flat knee pad 500. Flat knee pad 500 is seen to be significantly shorter in length than seat 300. Adjustably attached to knee pad 500 at an end furthest from seat 300 are two foot rollers 600. Seat 300, knee pad 500 and rollers 600 are at least covered with soft materials such as foam, plastic, and the like, while the other portions of the invention are largely made of metal and are hollow. These parts could be solid however and could instead be formed of woods or plastics or other suitable material. However, the goal of having a light but sturdy and durable device should be considered when making these choices.

Base rail 100 can be made of any metal and is preferably made of chrome. It can be hollow or solid but is preferably hollow. It is preferably square or rectangular in cross section. As noted above, it is I-shaped with both ends 102 being equal in size and length and square in cross section. One end 102, that which is below the foot plate 400, is welded to center piece 104. Base rail 100 has a main central axis which defines its entire length and lies parallel to the floor on which base rail 100 is situated. The center piece 104 which connects ends 102 is also square or rectangular in cross section and of a length greater than either of the two ends 102. Center piece 104 defines in at least one side which rests perpendicular to the floor, a plurality of holes 106.

Figure 4:
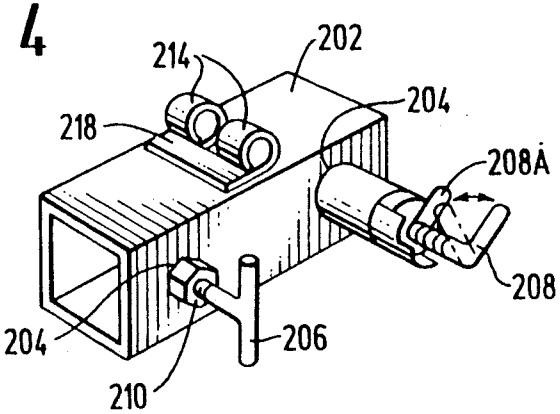
FIG. 4 is a detailed view of the torque bolt, toe pop pin and sled.

Surrounding center piece 104, is the first portion of support means 200. That is sled 202. FIG. 4 shows sled 202 in detail. It can be seen to be hollow and square or rectangularly shaped in cross section, although generally rectangular in general outer appearance. Sled 202 is dimensioned to surround center piece 104 but to be movably and slidably situated thereon. To assist its ability to slide it may have on its inner surface a teflon or other coating. Defined in one side of sled 202 are two openings 204. These openings accommodate in a first instance a T-shaped torque bolt 206, and in a second instance a toe pop pin 208. The torque bolt is threaded and seen to rotatably fit into nut 210 which is welded to or formed integrally with sled 202. Nut 210 is situated coaxial with one of the two openings 204. Torque bolt 206 is threadably engaged with nut 210 and passes through on the two openings 204 so that torque bolt 206 can be tightened to abut the surface of center piece 104. Torque bolt 206 is of a diameter to enable it to fit into one of holes 106 but it is spaced from toe pop pin such that when top pop pin is in line with any one of holes 106, torque bolt 206 is not in line with any one of holes 106. It is meant to merely abut the surface of center piece 104 to assist in holding the sled in place. For that reason it has an end not shown which coincides in shape with the surface of center piece 104 which it is to abut. In the shown drawings, this end would be flat. By turning torque bolt 206 to abut center piece 104, it may be moved perpendicularly away from and toward the center axis of base rail 100.

Figure 3:
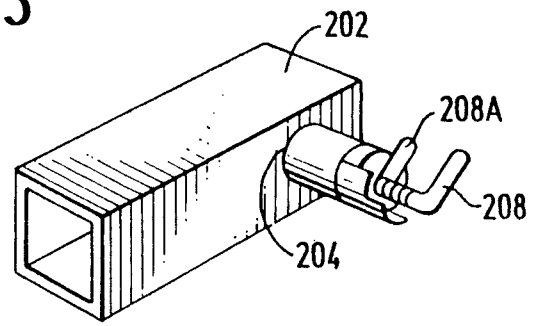
FIG. 3 is a detailed and diagrammatic view of the toe pop pin and ledge.

Toe pop pin 208, is shown axially spaced from the torque bolt 206. It is generally L-shaped in cross section and cylindrical. It fits into a tubular portion which communicates with the second opening 204. The second opening 204 is to be moved into coincidence with one of holes 106. When in this position, toe pop pin 208 can pass through both the second opening 204 and one of holes 106 to secure sled 202 in position on center piece 104. As noted above, torque bolt 206 is movable in and out of opening 204 and is generally perpendicular in its movement to the main axis of chrome base rail 100 which is meant to lie parallel to the floor. Similarly, toe pop pin 208 moves in and out perpendicular to the main axis of chrome base rail 100. Toe pop pin 208, while generally circular in cross section, has one protrusion 208A. (See FIG. 3.) Attached to the end of the tubular portion is a ledge with a notch. The protusion 208A may rest on the ledge or may pass beyond the ledge to the notch. Thus, by turning the toe pop pin 208 clockwise so that the protrusion 208A rests on the ledge, it is placed in an unlocked position no longer penetrating both openings 204 and 106. Toe pop pin 208 is then in an unlocked position. Toe pop pin 208 is particularly advantageous for the user of the board as it may be released and moved with one's toes since its end is not knob shaped as the other pop pins of this invention, but bar shaped.

Preferably, defined in center piece 104 are from 4 to 8 longitudinally spaced holes 106. More or less can be included to provide more or less positions for movement of sled 202 and thus angling of seat 300 and its attendant parts. This shall be better appreciated throughout the reading of this description. Sled 202 can be moved along center piece 104 to align the second of openings 204 with any one of holes 106. The toe pop pin 208 is then turned clockwise off the ledge and moved into one of the openings 106 via second opening 204. Torque bolt 206 is then tightened against center piece by turning and stress of positioning sled 202 is that particular position is shared by torque bolt 206 and toe pop pin 208. To move sled 202 of this position, torque bolt 206 is merely rotated in the opposite direction to draw it away from contact with center piece 104. toe pop pin 208 is rotated in a counter clockwise position and pulled away from the center axis of base 100 so that it can be placed on the ledge, and sled 202 is again movable on center piece 104.

Extending from top side of sled 202 are spaced rings 214. These rings are shown connected to a flat plate 218 which is welded to sled 202. However, rings 214 could as well be formed integrally with sled 202. Rings 214 are intended to flank either side of one end 212A of support flap 212 shown in FIG. 1 extending at an angle from sled 202.

Support flap 212 is rectangular in cross section and is rotatably supported on sled 202 by means of an opening defined in its end 212A which will lie between rings 214. Support flap 212 is preferably of solid metal construction. It can be seen from FIG. 4 where support flap 212 will rest for such pivotal support. Thus, in the end 212A of support flap 212, is the opening which will coincide with the openings defined by rings 214. Axle pin 215 is shown in FIG. 1 to pass through rings 214 and the opening in end 212A to enable support flap 212 to be pivotally attached to sled 202. Axle pin 215 could as well be a bolt.

Also shown in FIG. 1 are side rails 216 which extend at a different angle from sled 202. Side rails 202 obscure the view of rings 214 as they flank the outer sides of these rings. Side rails 218 also have openings in their ends which are near sled 202. These openings coincide with those openings defined by rings 214 and the opening in support flap 212 so that axle pin 215 passes through side rails 216, rings 214, and support flap 212. With such attachment, side rails 216 are seen also to be rotatably attached to sled 202.

The length of axle pin 215 is such that it extends through side rails 216, rings 214, and support flap 212 and still protrudes out of the sides of side rails 216 by ⅛th to 1/8th of an inch.

Side rails 216 are rectangular in shape and square in cross section. They are preferably of solid metal construction. At their ends opposite sled 202 they are bolted by means of bolt 220 to a seat rail 222. Side rails 216 can pivot at this connection as well as at their connection with sled 202.

Seat rail 222 is seen to be square or rectangular in cross section, generally hollow, metal, rectangular in general view and attaching to seat 300. Seat rail 222 has a main lengthwise axis which will lie parallel to the main lengthwise axis of seat 300 when the two are attached. Seat rail 222 is longer in length than seat 300. Side rails extend on either side of support flap 212. They rest at an angle with respect to seat rail 222 this angle preferably being between 20 degrees and 70 degrees. Thus side rails 216 are solidly and non movably mounted to seat rail 222 and rotatably mounted with respect to sled 202 and base rail 100.

Turning to seat rail 222 more specifically, it can be seen to have an end which attaches to foot plate 400 and an end which extends beyond the length of seat 300. At this latter end, extending from its base which is opposite the side of seat rail 222 which connects to seat 300, are a plurality of spaced metal rail tabs 224. These are spaced parallel and along the major axis of seat rail 222. They are welded or formed integrally with seat rail 222 and preferably extend at an angle from the base of seat rail 222. As well illustrated in FIGS. 1 and 5, support flap 212 interacts with seat rail tabs 224 to change the angle of seat 300 with respect to base rail 100. That is, by lifting up on the seat rail 222 or seat 300, support flap 212 can be moved out of position with one tab and into position with another tab. Support flap 212 then can be moved out of its position by rotating it toward base rail 100 and placed in a new position against another tab 224.

At the end of seat rail 202 opposite of the location of seat rail tabs 224 is seen bolt 226. This bolt bolts flap 228 which is welded to seat rail 202 to base rail 100 generally very near the joinder of center section 104 and end 102. This bolt may pass directly into base rail 100 or into rings formed on base rail 100 in the fashion of the ring attachment shown with respect to sled 202. At bolt 226 is a pivot point between seat 300, seat rail 222 and base rail 100.

Seat 300 is bolted to seat rail 222 at bolts 232 which interact with lock washers not shown. Metal flaps 234 welded to the top surface of seat rail 222 receive bolts 232 which pass into the back of seat 300. While two flaps are shown in the drawings, more could be used. The back of seat 300, while possibly covered with plastic on the side which abuts seat rail 222 and upholstered on the opposite side is preferably solid wood or plastic or metal so that it may hold bolts 232. The bolts attach the upholstered seat 300 to the seat rail 222 and should be tightened until the lock washers are completely depressed.

Figure 5:
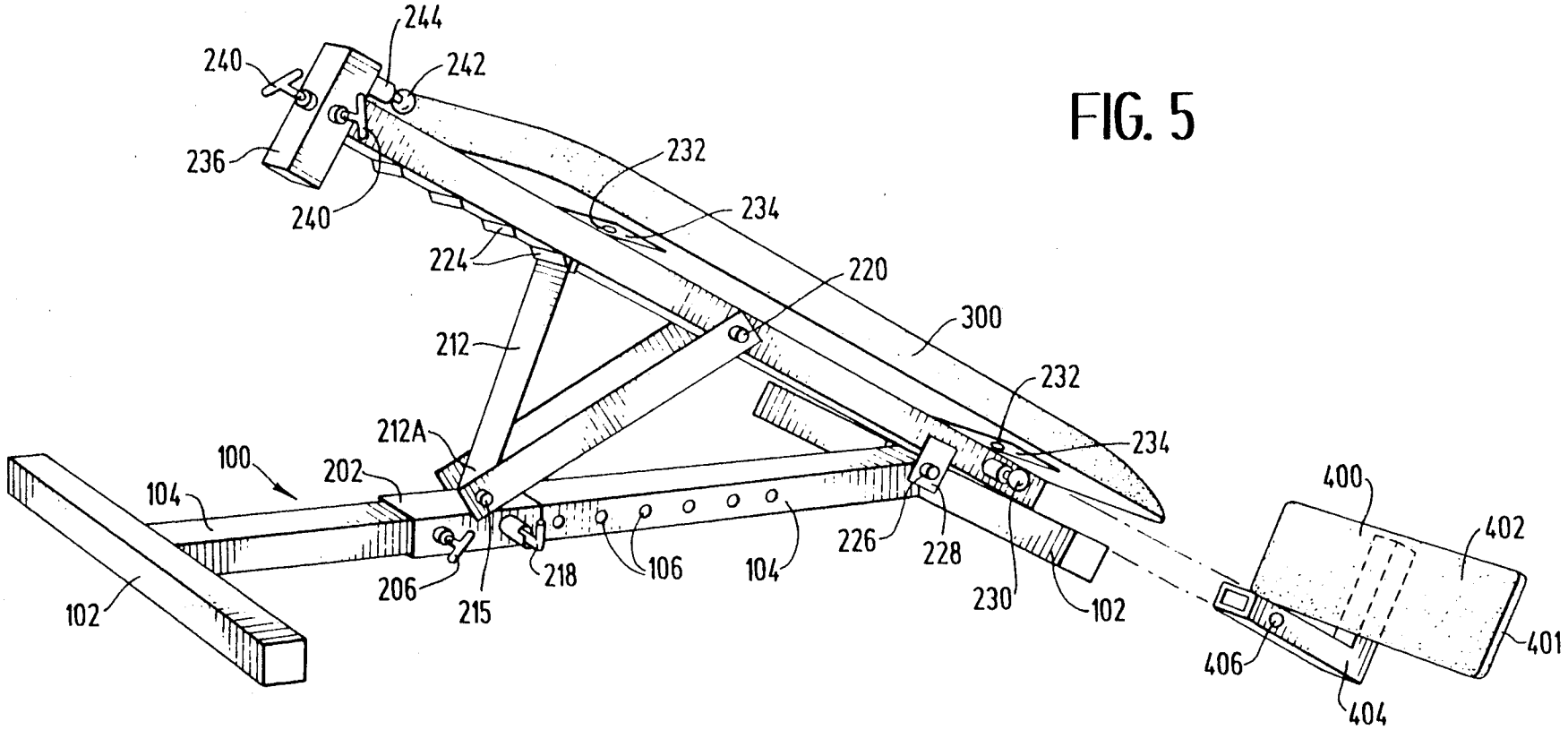
FIG. 5 is a detailed view of the device without the foot rollers and leg attachment post.

Beyond bolt 226 near the end of seat rail 222 is shown pop pin 230 and then the open end of seat rail 222. At that end of seat rail 222 nearest pop pin 230, is seen foot plate 400. FIG. 5 advantageously discloses the construction of foot plate 400. It is seen to have a flat rectangular portion 402 with sides 401 which is connected by welding or other means to an L-shaped hollow rectangular portion 404. The portion of the L which connects to the foot plate 400 is rectangular or square in cross section and on one side of foot plate 400 extends beyond that side and then makes a right angle to form its other leg. It does not extend beyond the other edge of foot plate 400, as may be seen in FIG. 2. It does extend along a substantial width of foot plate 400. The other portion of the L, the other leg just discussed, extends perpendicular to the foot plate and is received within seat rail 222. At the portion of the L which extends within seat rail 222 is at least one opening 406. Opening(s) 406 is necessary to secure L shaped hollow rectangular portion in seat rail 222 by passing pop pin 230 through seat rail 222 into opening 406. Opposite bolt 230, on the opposing side of seat rail 222 is a torque bolt. This bolt is not shown but is constructed as the other torque bolts are constructed in this invention. It abuts the other side of 404 as it extends into side rail 222. By using a plurality of openings 406 in L-shaped portion 404, the distance of foot plate 400 with respect to seat 300 may be adjusted. As can be seen, foot plate 400 rests perpendicular to the main axis of seat 300. On the other hand, the portion of the L-shaped connection means 404 which is received by seat rail 222 is parallel to the main axis of seat 300. Foot plate 400 may be made of wood, metal, or plastic and is solid. It is preferably not upholstered so that the user of the device may obtain adequate balance thereon.

As well shown in FIGS. 1 and 5, seat rail 222 extends beyond the length of seat 300 and ends at that end opposite foot plate 400 with sleeve 236. Sleeve 236 is welded to or formed with seat rail 222 and is perpendicular thereto. Sleeve 236 is hollow to accept leg attachment post 502 which is shown to be generally V shaped, one leg of the V extending into sleeve 236. Leg attachment post 502 is rectangular in shape and square or rectangular in cross section. It is slidably received within sleeve 236. It may be hollow or solid and is preferably of metal and in that group of chrome, but it could be made of other materials. The apex of the V of post 502 attaches to knee pad 500.

In sleeve 236, are two openings 238. One each of these openings is defined in the sides of sleeve 236. These openings 238 accommodate torque bolts 240 which interact with sleeve 236 and leg attachment post 502 in the same fashion that torque bolt 206 interacts with sled 202 and center piece 104. That is, torque bolts 240 threadably engage nuts which are attached to sleeve 236 so that torque bolts 240 can be tightened against leg attachment post 502.

Extending from a third side of sleeve 236 and opposite of one of torque bolts 240, is pop pin and knob 242. This pop pin and knob 242 is seen to have the same construction as that used with foot plate 400. Knob 242 is seen to extend from sleeve 236 toward seat 300. Pop pin 242 passes through an opening defined by means of a protruding cylinder 244 formed on the third side of sleeve 236. Pop pin and knob 242 holds leg attachment post 502 firmly in position with respect to seat 300 by passing through an opening in leg attachment post 502. This post defines at least one opening in its surface to enable the adjustment of the height of knee pad 500.

Figure 6:
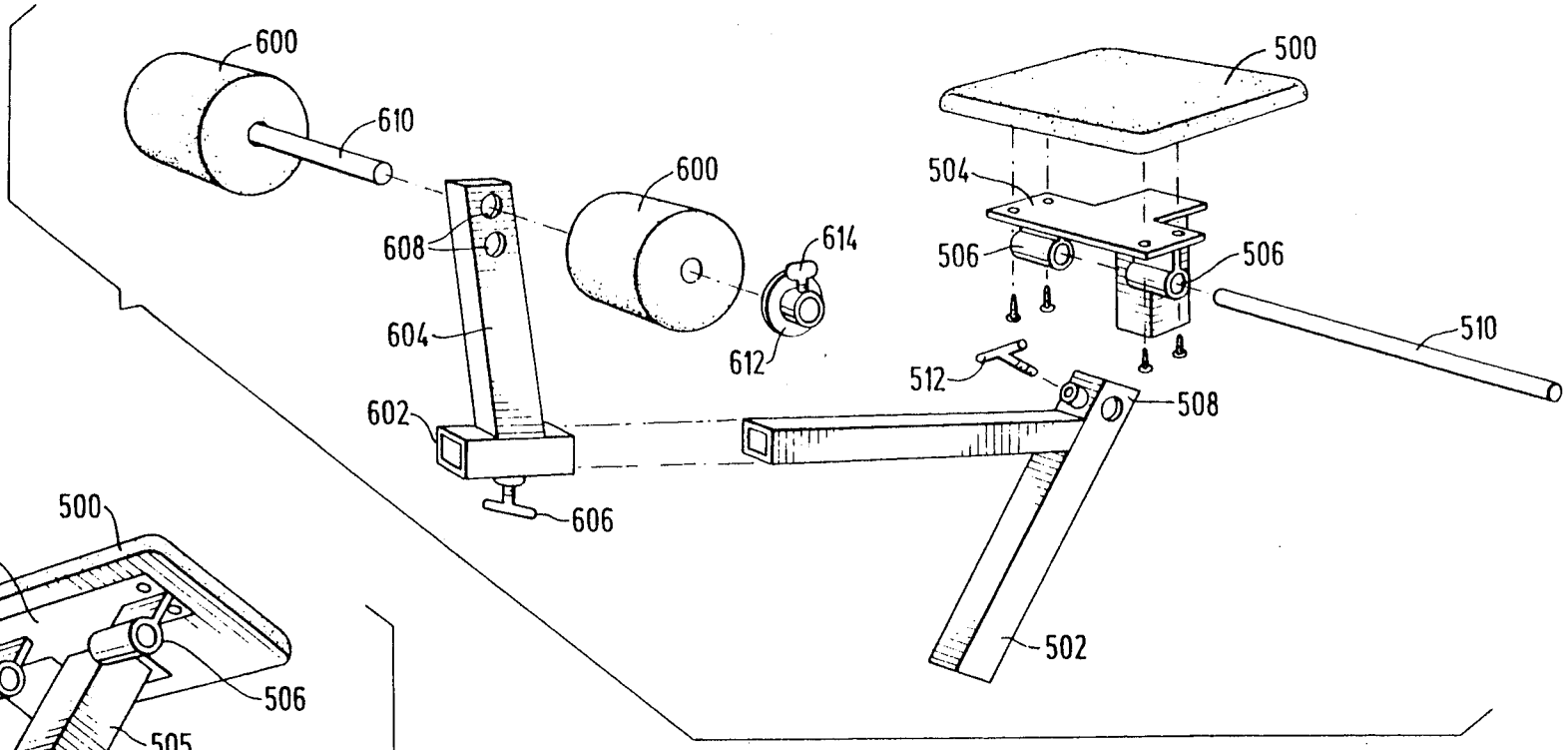
FIG. 6 is an exploded view of the knee pad, foot rollers, and surrounding parts.

Turning now to FIG. 6, the attachment between knee pad 500 and leg attachment post 502 is well illustrated. The knee pad 500 is bolted onto T-shaped or rectangular plate 504. Knee pad 500 is constructed generally in the same fashion as seat 300 in that is contains a solid support base into which the bolts may pass and be held. Plate 504 has openings for bolts and washers which pass therethrough into knee pad 500. Plate 504 has depending from that side opposite its attachment to knee pad 500, rings 506. Rings 506 are really tubes which are each about three inches in length. Rings 506 are placed on either side of bar receiving means 508 which is formed as part of the apex of leg attachment post 502. Bar receiving opening is shown to be generally square or rectangular shaped in cross section with an opening passing therethrough. Hand bar 510 passes through rings 506 and bar receiving means 508 to secure the knee pad to the leg attachment post 502. Bolt 512 then extends through bar receiving opening to abut hand bar 510 so that knee pad 500 is rotatably mounted on hand bar 510 while hand bar 510 is itself kept from rotating. The Hand bar 510 is cylindrical and bolt 512 abuts it. As can be seen, hand bar 510 extends beyond knee pad 500 a sufficient enough length such that one could place the palm of each hand on either side of knee pad 500. Knee pad 510 is kept from lateral movement on hand bar 510 by the abutment of rings 506 against bar receiving means 508. Thus rings 506 are spaced from each other a distance enough to enable them to receive and abut the side edges of bar receiving means 508.

The free leg of leg attachment post 502, which leg is the leg which does not slip within sleeve 236, extends parallel to knee pad 500. It fits within a sleeve 602 defined at the end of foot bar holder 604. Sleeve 602 is square or rectangular in cross section and generally rectangular in shape. Securement of the free leg of leg attachment post 502 within sleeve 602 is by means of torque bolt 606 which engages the free leg of leg attachment post 502 in the same means as previous torque bolts discussed herein engage portions of this device. That is, torque bolt 606 threadably engages a nut, and may be turned to abut the surface of leg attachment post 502 so that leg attachment post 502 is held in place in sleeve 602. Torque bolt 606 is seen to extend perpendicular to free leg of leg attachment post 502 and at the base of that post so that downward forces placed on roller 600 are directed in line and parallel to the major axis of torque bolt 606. Torque bolt 606 enables infinite adjustment of the rollers.

Foot bar holder 604 is generally T-shaped with the horizontal portion of the T forming sleeve 602. The vertical portion of the T engages foot rollers 600. The portions of the T are generally square in cross section although they could be rectangular also. Foot rollers 600 and their attachment to foot bar holder 604 is again advantageously shown in FIG. 6. Here it can be seen that in the end of foot bar holder 604, opposite sleeve 602 are openings 608. Foot rollers 600 are axially mounted on bar 610 which is cylindrical in shape and passes centrally through foot rollers 600. Foot rollers 600 can be mounted on cylindrical bar 610 in a stationary fashion or can be rotatably mounted thereon.

The foot rollers 600 are attached to the foot bar holder 604 in the following way. The foot bar 610 is inserted into one of the rollers 600. The bar is then inserted through one of the top holes 608 in the foot bar holder and into the next foot roller to extend out of the end thereof. The rollers 600 are secured on the foot bar 610 by means of a collar 612 which is tightened in position against the ends of both foot rollers 600 by means of thumb screw 614. Instead of using two collars, the foot bar 610 could have a widened section at one end or a plate, so that the first roller which is threaded onto the foot bar 610 would abut this end plate. The only one collar would be needed at the other end of the foot bar 610.

It is noted that the foot bar 610 and the hand bar 510 could be used interchangeably even though their lengths differ. This enables the user instead to place his hands near the sides of the rollers if the hand bar 510 is used with the rollers.

Accordingly, it can be seen that the foot rollers 600 are adjustably mounted with respect to the knee pad 500. The foot rollers can be brought closer to or further away from the knee pad 500. The knee pad 500 can be adjusted in height with respect to the seat 300. The foot plate 400 can be adjusted to be flush against the end of seat 300 or to be separated therefrom. The foot plate 400 may be completely removed from the device and not used therewith. Similarly, the foot rollers 600 can be completely removed from the device and not used therewith.

The knee pad 500 can be brought into a position such that it is in line with and thus on the same plane as the seat 300. The two will form a straight line together. Incorporated herein and made a part hereof is the Explore brochure showing the present invention in various positions. Herein, it can be seen that the foot roller 600, and knee pad 500, and seat 300 may be at separate levels or the knee pad 500 and seat 300 may be completely in alignment with one another. Further, it can be seen that the device can be used without the foot plate 400 and- /or without the rollers 600 and foot bar holder 604. In fact, if desired, the device can be used with only the seat 300 and its attachment means to the chrome base 100.

It is preferable that the knee pad 500 and seat 300 be padded foam cushions on wood or metal frames. It is preferable that the foot rollers be foam, rubber, hollow plastic or solid plastic. Foam is preferred as it is lighter and more comfortable to use. If they are to be rotatably mounted, they would have a central core perhaps of metal to slide around foot bar 610.

The angle formed between the foot bar holder 604 and the free end of the leg attachment post 502 in these figures is shown to be 30 to 70 degrees. In an embodiment made of this invention the following dimensions were found suitable. Base 100 was 45½" in length and 2" in width and 2" in height. It was made hollow. The length of each end piece 102 was 24". Support flap 212 had the dimensions of 11½"×2"×¼" and was solid. Side rails 216 were made solid and dimensioned 18"×2"¼". Seat 300 was hollow and 49"×2"×2". Sleeve 236 added another 2" to this length. Sleeve 236 had dimensions of 6"×2"×2". Seat 300 was of a length 43"×18". Support leg 502 had the horizontal leg between 8" and 12", the leg which engaged sleeve 236 between 14" and 18" and the angle between the legs between 30 degrees and 60 degrees. The roller post 604 without sleeve 602 was about 10". The dimensions of sleeve 602 was 2¼"×4". The knee pad 500 was 9" by 18" in surface measurements, thickness being between 1" to 2". The roller lengths were each 7" with diameters of 4". The space between the end of seat 300 near sleeve 238 and sleeve 236 was about 5½". Between the seat 300 end near sleeve 238 and knob 242 was about 3¼". The foot plate 400 had dimensions 18" by 7 to 11" with about 1" edges. The hand bar was about 36" with a diameter of ⅞" and could be hollow or solid. The foot bar was 17 to 26", hollow or solid, with a diameter of ⅞". The last tab 224 was situated about 12 to 16" away from sleeve 238. The foregoing are just suggested one set of measurements and proportionalities which the present invention can embody. Those skilled in the art will readily appreciate the adjustments measurements available to them in view of the force vectors presented by the present design.

In summary, the pop pins are used for adjusting the device in different positions. They work by pulling them out approximately ¾ of an inch. This allows the piece which they secure to move. When the pin is released it pops into the nearest hole and locks the pieces secured into the desired position. Again, one pop pin holds the leg attachment means, one holds the foot plate 400 and the toe pop pin is on sled 202 on the base 100. The pop pins in this description enable the adjustment of the parts which they engage in various positions. With the exception of the toe pop pin, pop pins and their mechanisms are well known in the art. The toe pop pin in this description differs in that in does not contain a knob, it has a protrusion, and it interacts with a notched ledge.

The torque bolts tighten against the moving parts to keep them from moving out of position. They are tightened or loosened by the fingers. The support flap 212 is shown to rest against one of the seat rails 224 to adjust the seat 300 into five possible slanting positions. Five rail tabs are shown, the last one, furthest from sleeve 236 is very close to the preceding one and has less of an angle than the other tabs 224. More than five rails could be used, such as one adjacent sleeve 236 and the point where seat rail 222 extends from sleeve 236.

The toe pop pin 208 locks the seat 300 into one of six slanting positions or a flat position.

Figure 7:
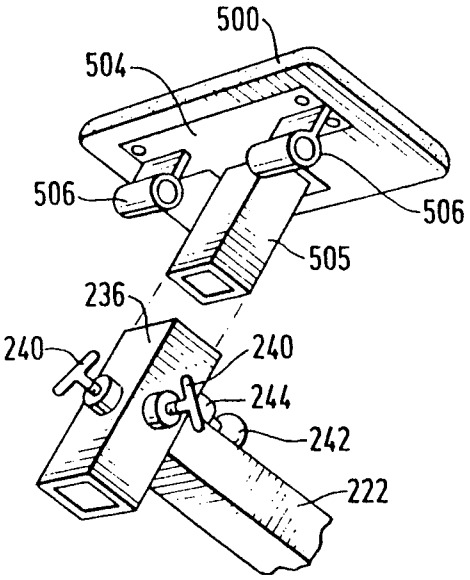
FIG. 7 is an exploded view of the knee pad and surrounding parts for use with the device absent the rollers and leg attachment post.

In the highest positions of the seat with respect to the base 100, the foot plate 400 and knee pad 500 are generally used. The foot roller 600 and the foot bar holder 604 and leg attachment post do not need to be used but may be. In this instance, the knee pad acts as a head rest. It may be secured in this position to sleeve 236 in one of two way. FIG. 7 shows one method. In this method, square or rectangular tube 505 and its accompanying plate are attached to the base of knee pad 500 in the same fashion plate 504 is attached. As can be seen from FIG. 7, it is attached forwardly of plate 504 so that it is located closer to seat 300 than is plate 504. The square tube 505 is then inserted within the sleeve 236 formed at the end of seat rail 202 such that knee pad 500 is level with or above seat 300 as desired. The pop pin 242 holds the seat in the desired position while the torque bolts 240 also helps secure it in the desired position.

As an alternative, rectangular tube 505 and its plate may be dispensed with entirely. In this instance, sleeve 236 is formed with a hole for receipt of hand bar 510. Rings 506 then either fit within sleeve 236 so that hand bar 510 passes through one side of sleeve 236, through the rings 506 and then through the other side of sleeve 236 respectively. Alternatively, the rings may rest on the outside sides of sleeve 236 so that hand bar 510 passes through a first ring 506, then a first side of sleeve 236, next through a second side of sleeve 236, and finally through the second ring 506. In these latter two instances, the pop pin and knob 242 abut the hand bar 510.

When the device is in a lower or flat position, the foot plate is generally inserted or removed.

The knee pad is not meant to dig into the back of the user's leg or the underbelly of the knee. The foot rollers are positionable to rest in the hollow of the ankle not on the calf or on top of the foot.

The invention can be used in positions not shown or specifically described herein by removal of or interchanging of parts. As an example, seat 300 and seat rail 222 may be positioned such that it rests generally flat on base 100.

The present, invention is claimed as follows:

1. An exercise device comprising:

a pad member defining an upper surface;

a base supporting the pad member;

an elongated rail member having a first end pivotally connected to the pad member;

a movable sled disposed adjacent the elongated rail and slidable along at least a portion of the length of the elongated rail; and at least one side rail having a first end pivotally connected to the sled and a second end pivotally connected to the pad member such that the angle of the upper surface of the pad member with respect to the elongated rail changes as the side rail pivots with respect to the elongated rail and the sled, and as the sled slides along at least a portion of the length of the elongated rail.

2. An exercise device as claimed in claim 1, wherein the pad member comprises:

an elongated pad for supporting a user; and a second elongated rail member attached to the elongated pad along the length of the elongated pad;

wherein the pivotal connection of the side rail to the elongated pad member comprising a pivotal connection of the second end of the side rail to the second elongated rail.

3. An exercise device as claimed in claim 2, further comprising a locking device for locking the pad member in a fixed position with respect to the elongated rail at any one of a plurality of angles defined by the upper surface of the elongated pad with respect to the elongated rail, wherein the locking device comprises:

a plurality of rail tab members extending from the second elongated rail; and a support are having a first end pivotally connected to the sled and a second end engagable with the plurality of rail tab members.

4. An exercise device as claimed in claim 1, further comprising locking means for maintaining the pad member in a fixed position with respect to the elongated rail at any one of a plurality of angles defined by the upper surface of the elongated pad with respect to the elongated rail.

5. An exercise device as claimed in claim 4, wherein the locking means comprises means for locking the movable sled in a fixed position with respect to the elongated rail at any one of a plurality of locations along the length of the elongated rail.

6. An exercise device as claimed in claim 5, wherein the locking means further comprises:

a plurality of rail tab members extending from the second elongated rail; and a support arm having a first end pivotally connected to the sled and a second end engagable with the plurality of rail tab members.

7. An exercise device as claimed in claim 1, further comprising a sled lock device operable to lock the movable sled in a fixed position with respect to the elongated rail at any one of a plurality of locations along the length of the elongated rail.

8. An exercise device as claimed in claim 7, wherein the sled is provided with a first opening therethrough, the elongated rail member is provided with at a plurality of openings and the sled lock device comprises a pin extendable through the first opening of the sled and through any one of the plurality of openings of the elongated rail member.

9. An exercise device as claimed in claim 2, wherein the second elongated rail member has a first end and a second end, the exercise device further comprising:

a sleeve connected to the first end of the second elongated rail member and defining a hollow interior passage extending substantially perpendicular to the second elongated rail member;

a second pad;

a post supporting the second pad and extending into the hollow interior passage of the sleeve.

10. An exercise device as claimed in claim 9, wherein the post is configured to slide within the interior of the sleeve along the hollow interior path defined by the sleeve, the exercise device further comprising locking means for maintaining the post in a selectable fixed position with respect to the sleeve such that the second pad is maintained at a selectable position with respect to the sleeve.

11. An exercise device as claimed in claim 9, further comprising means for pivotally connecting the second pad to the post for pivotal movement with respect to the post.

12. An exercise device as claimed in claim 9, further comprising:

an arm extending from the post;

a second sleeve defining a hollow interior passage through which the arm extends;

a second arm extending from the second sleeve; and at least one roller pad supported by the second arm.

13. An exercise device as claimed in claim 12, further comprising locking means for maintaining the second sleeve at a fixed location with respect to the arm at any one of a plurality of locations along the length of the arm.

14. An exercise device as claimed in claim 12, further comprising rotatable connecting means for connecting the roller pad to the second arm for rotation with respect to the second arm.

15. An exercise device as claimed in claim 2, wherein the second elongated rail member has a first end and a second end, the exercise device further comprising a foot plate connected to the second end of the second elongated rail and extending substantially perpendicular to the upper surface of the pad member.

16. An exercise device comprising:

an elongated pad defining an upper surface and a lower surface;

a base supporting the elongated pad;

adjustment apparatus connecting the base and the elongated pad, the adjustment apparatus having:

a first elongated rail member extending along the length of the lower surface of the elongated pad;

a second elongated rail member having a first end pivotally connected to the first elongated rail;

a movable sled slidably disposed on the second elongated rail and slidable along at least a portion of the length of the second rail; and at least one side rail having a first end pivotally connected to the sled and a second end pivotally connected to the first rail such that the angle of the second rail changes as the side rail pivots with respect to the first rail and the sled and as the sled slides along at least a portion of the length of the second rail.

17. An exercise device as claimed in claim 16, further comprising locking means for maintaining the elongated pad in a fixed position with respect to the second elongated rail at any one of a plurality of angles defined by the upper surface of the elongated pad with respect to the second elongated rail.

18. An exercise device as claimed in claim 17, wherein the locking means comprises means for locking the movable sled in a fixed position with respect to the second elongated rail at any one of a plurality of locations along the length of the second elongated rail.

19. An exercise device as claimed in claim 17, wherein the locking means comprises:

a plurality of rail tab members extending from the first elongated rail; and a support arm having a first end pivotally connected to the sled and a second end engagable with the plurality of rail tab 20. An exercise device comprising:

a pad member defining an upper surface;

a base supporting the pad member;

an elongated rail having a first end pivotally connected to the pad member;

a movable sled disposed adjacent the elongated rail and slidable along at least a portion of the length of the elongated rail;

at least one side rail having a first end pivotally connected to the sled and a second end pivotally connected to the pad member such that the angle of the upper surface of the pad member with respect to the elongated rail and the sled, and as the sled slides along at least a portion of the length of the elongated rail; and a locking device for locking the pad member in a fixed position with respect to the elongated rail at any one of a plurality of angles defined by the upper surface of the elongated pad with respect to the elongated rail, wherein the locking device comprises:

a plurality of tab members extending from the pad members; and a support arm having a first end pivotally connected to the sled and a second end engagable with the plurality of tab members.

* * * * *